US011156184B2

(12) United States Patent
Sahasrabudhe et al.

(10) Patent No.: US 11,156,184 B2
(45) Date of Patent: Oct. 26, 2021

(54) CYLINDER COOLING IN OPPOSED-PISTON ENGINES

(71) Applicant: ACHATES POWER, INC., San Diego, CA (US)

(72) Inventors: Abhishek Sahasrabudhe, San Diego, CA (US); Miles Linscott, San Diego, CA (US); Sebastian Strauss, Missoula, MT (US)

(73) Assignee: Achates Power, Inc., San Diego, CA (US)

( * ) Notice: Subject to any disclaimer, the term of this patent is extended or adjusted under 35 U.S.C. 154(b) by 0 days.

(21) Appl. No.: 16/655,076

(22) Filed: Oct. 16, 2019

(65) Prior Publication Data

US 2021/0115873 A1 Apr. 22, 2021

(51) Int. Cl.

| | |
|---|---|
| ***F02F 1/16*** | (2006.01) |
| ***F02B 75/28*** | (2006.01) |
| ***F01P 3/02*** | (2006.01) |
| ***F01P 7/14*** | (2006.01) |
| ***F02B 25/02*** | (2006.01) |
| ***F02B 75/02*** | (2006.01) |

(52) U.S. Cl.

CPC ..... *F02F 1/16* (2013.01); *F01P 3/02* (2013.01); *F01P 7/14* (2013.01); *F02B 25/02* (2013.01); *F02B 75/02* (2013.01); *F02B 75/28* (2013.01); *F01P 2003/021* (2013.01); *F01P 2007/143* (2013.01); *F02B 2075/025* (2013.01)

(58) Field of Classification Search

CPC ..... F02F 1/16; F01P 3/02; F01P 7/14; F01P 2003/021; F02B 75/28

USPC ..... 123/41.73

See application file for complete search history.

(56) References Cited

U.S. PATENT DOCUMENTS

| | | | | |
|---|---|---|---|---|
| 1,231,903 | A | 7/1917 | Junkers | 123/41.78 |
| 1,410,319 | A | 3/1922 | Junkers | 123/41.78 |
| 1,495,326 | A | 5/1924 | Junkers | 123/41.78 |
| 1,818,558 | A | 8/1931 | Junkers | 123/41 |
| 1,892,277 | A | 12/1932 | Junkers | 123/41.78 |
| 6,182,619 | B1 | 2/2001 | Spitzer et al. | 123/51 |
| 9,121,365 | B1 * | 9/2015 | Wagner | F02F 1/004 |
| 2013/0025548 | A1 * | 1/2013 | Liu | F02B 75/282 123/41.17 |

* cited by examiner

*Primary Examiner* — Lindsay M Low
*Assistant Examiner* — Omar Morales
(74) *Attorney, Agent, or Firm* — Terrance A. Meador; Julie J. Muyco

(57) ABSTRACT

A cylinder assembly with a cylinder liner and a sleeve is provided that includes features that reduce coolant flow stagnation. The sleeve encloses a center section of the cylinder liner to form cooling channels that removes excess heat from the combustion area of the cylinder. The cylinder liner includes features for cooling between bridges in the cylinder's exhaust port.

20 Claims, 9 Drawing Sheets

CYLINDER COOLING IN OPPOSED-PISTON ENGINES

STATEMENT REGARDING FEDERALLY SPONSORED RESEARCH

This invention was made with government support under Award No.: DE-AR0000657 awarded by the Advanced Research Projects Agency-Energy (ARPA-E) of the Department of Energy. The government has certain rights in the invention.

FIELD

The field relates to cooling of a ported cylinder for an opposed-piston engine. In particular, the field pertains to the configuration of structures in the ported cylinder to improve coolant flow.

BACKGROUND

Uniflow-scavenged, two-stroke opposed-piston engines have cooling needs that differ from that of conventional engines with only one piston per cylinder and a cylinder head. In each cylinder of uniflow-scavenged, two-stroke opposed-piston engines as described herein, two pistons move to form a combustion chamber near the center of the cylinder. Combustion occurs when these pistons attain minimum volume; a position that is sometime equated with top center in a conventional engine. These engines have intake and exhaust ports in the cylinder sidewall, spaced-apart along the length of the cylinder so that one end can be designated the intake end and the other the exhaust end of the cylinder.

The configuration of uniflow-scavenged, two-stroke, opposed-piston engines, with a combustion chamber that forms approximately in the center of each cylinder and with intake and exhaust ports at different ends, creates different cooling needs along the length of each cylinder. Particularly, the area surrounding the combustion chamber, or combustion area of the cylinder, and the exhaust port require significant cooling to maintain the structural integrity of the cylinder, preventing deformation of the bore along the length of the cylinder, as well as to obtain the most power density possible. The cylinder assemblies provided herein have cooling features that allow for a reduction in coolant flow stagnation, reducing temperature extremes (i.e., hot spots and cold spots) in an opposed-piston engine.

SUMMARY

A cylinder assembly with cooling channels for an opposed-piston engine is described herein. The cylinder assemblies described are for uniflow-scavenged, two-stroke opposed-piston engines. In these engines, each cylinder has two pistons that reciprocate during operation, and the combustion chamber forms as the pistons meet near the center of the cylinder. Because of the location of the combustion chamber, along with the differences in temperature along the length of the cylinder assembly during scavenging, when cooler charge air enters the intake port and exhaust gas exits the exhaust ports, effective coolant delivery to the cylinder assembly is critical to prolong the lifetime of the cylinder assembly, ensure engine durability, and maintain the target power density of the engine in which the cylinder assembly is used.

The cylinder assembly described herein includes a cylinder liner that includes a sidewall and a sleeve covering a center section of the cylinder sidewall. In the cylinder liner are longitudinally-spaced apart exhaust and intake ports that open through the cylinder liner sidewall into a bore in which the pistons reciprocate during engine operation. The exhaust and intake ports are each made up of one or more circumferential arrays of openings with bridges between the openings. The cylinder sidewall has a plurality of cooling feed channels that extend from the combustion area towards the intake port on one side of a central section of the cylinder liner. On the other side of the cylinder liner's central section are cooling feed channels that extend from the combustion area toward the exhaust port. The sleeve has a plurality of impingement jet ports that pass through the sleeve's sidewall. The impingement jets are arranged in at least one sequence around the combustion area. The impingement jets are configured to be in liquid communication with the plurality of cooling feed channels in the cylinder liner sidewall when coolant is present in the engine. The sleeve also has spaced-apart annular recesses on its inside surface; one recess is closer to the exhaust port and the other closer to the intake port. These annular recesses are features that define, in combination with features on the cylinder liner sidewall, annular coolant reservoirs that are configured to be in liquid communication with the plurality of cooling feed channels. Each cooling feed channel has an outlet into a coolant reservoir; each outlet is a tangential outlet in that it curves into the coolant reservoir in a direction that is tangential to the coolant reservoir so as to reduce coolant flow stagnation in the coolant reservoir. Other features of the cylinder assembly may encourage coolant flow to reduce or eliminate coolant stagnation while allowing for the appropriate coolant flow rates. One such feature is the presence of one or more bypass ports that provide a fluid flow path from a coolant reservoir adjacent to the exhaust port out of the cylinder assembly. The bypass port or ports may have sidewalls at an angle 9 from a line perpendicular to a tangent line taken on an inner surface of the sleeve at the bypass port.

DETAILED DESCRIPTION

In an opposed-piston engine with at least one cylinder where the combustion chamber is formed between end surfaces of the opposing pistons in the cylinder, cooling of the center section of the cylinder is important for optimizing power density of the engine. In uniflow, two-stroke opposed-piston engines, cooling the portion of the cylinder through which exhaust gas exits is critical to maintaining the structural integrity of the cylinder. Described below is a cylinder assembly that cools the cylinder portions that experience the greatest temperatures, the center portion and the exhaust end of a cylinder for an opposed-piston engine.

Figure 1:
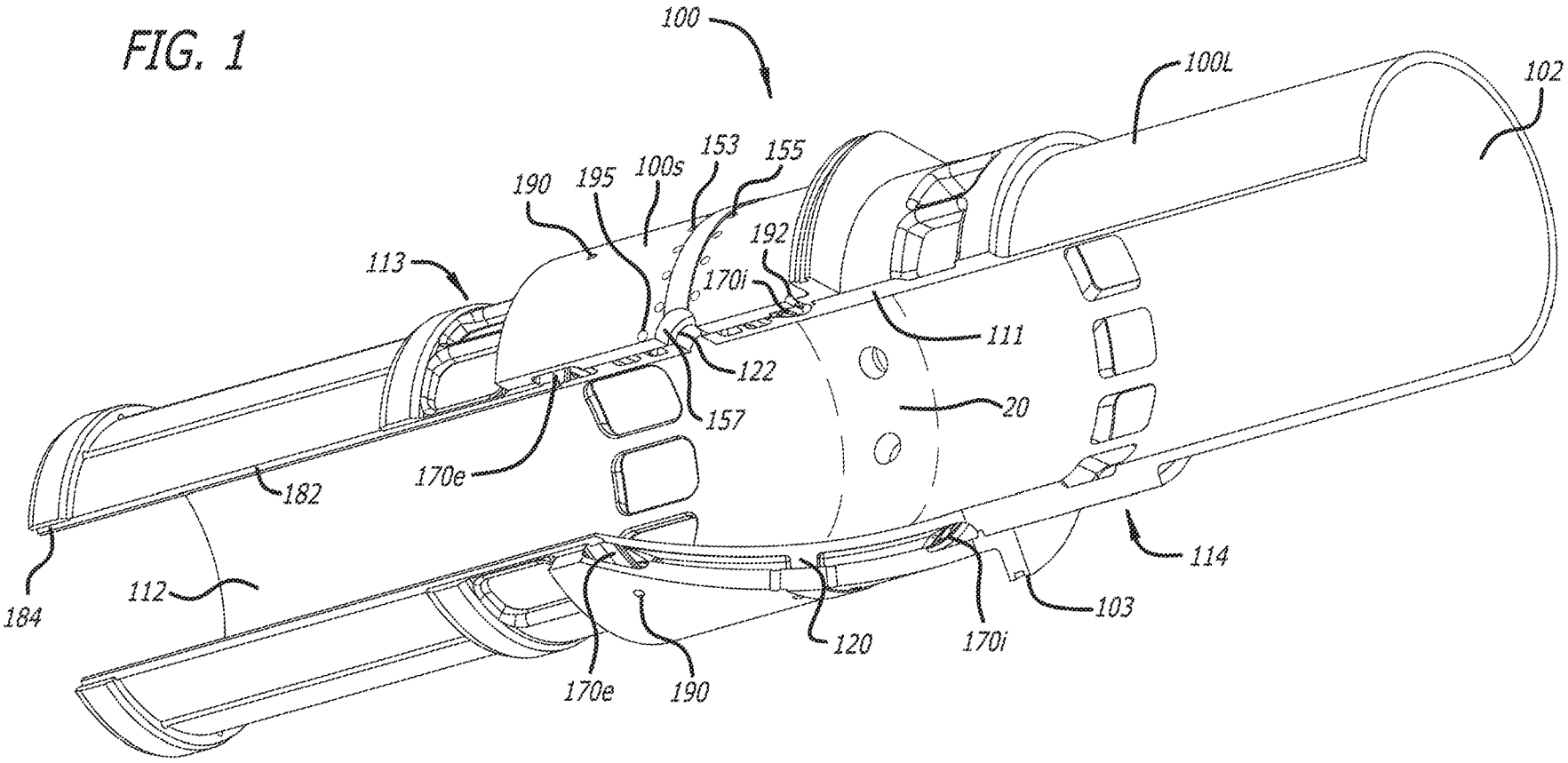
FIG. 1 shows a cylinder assembly with cooling features.
Figure 2:
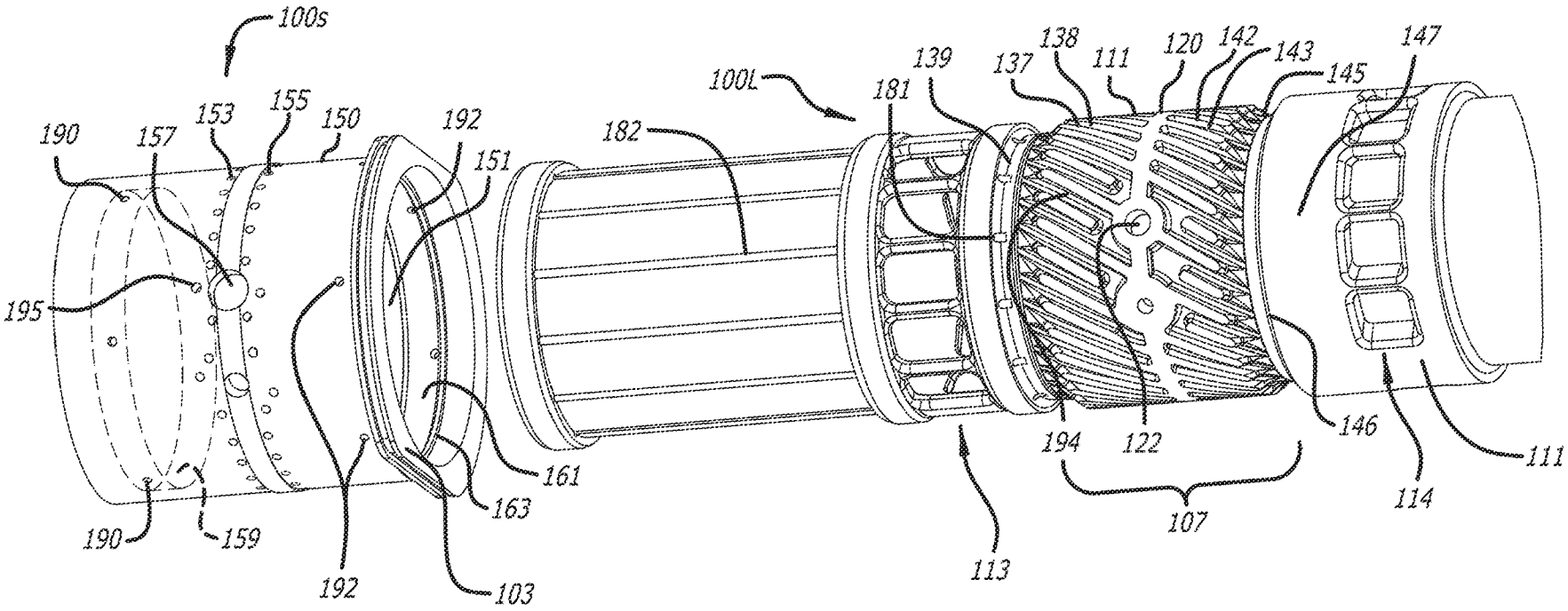
FIG. 2 shows the cylinder assembly of FIG. 1 in an exploded view.

FIGS. 1 and 2 show a cylinder assembly 100 that includes a liner 100L and a sleeve 100*s*. The cylinder liner 100L includes a bore with a running surface 110, a sidewall 111, an exhaust port 113 in an exhaust end 112 of the cylinder liner 100L, an intake port 114 in an intake end 102 of the cylinder liner 100L, and a center section 107 of the cylinder. The exhaust port 113 and intake port 114 are each made up of an array of openings through the cylinder sidewall 111. Each of the intake and exhaust ports includes one or more openings communicating between the cylinder bore and an associated manifold or plenum (not seen in these figures) in an opposed-piston engine. As the term is used in this description, a"port" comprises one or more circumferential arrays of openings in which adjacent openings are separated by a solid portion of the cylinder wall (also called a "bridge" or a "bar"). In some other descriptions, each opening may be referred to as a "port"; however, the construction of a circumferential array of such "ports" is no different than the port constructions illustrated in FIGS. 1 and 2 and described herein.

The center section 107 is between the intake port 114 and the exhaust port 113. In the center section 107 of the liner is the combustion area 20, where the pair of opposing pistons reach minimum volume and form a combustion chamber in the cylinder. The sleeve 100*s* is configured to fit around the center section 107 of the cylinder liner. The sleeve 100*s* can include a flange 103, an inner surface 151, coolant impingement jet ports 153 and 155, auxiliary coolant jet ports 195, coolant bypass ports 190, coolant exit ports 192, an exhaust end annular recess 159, and an intake end annular recess 161 that is adjacent to an alignment flange 163 on the inner surface 151 of the sleeve 100*s*. Ports, or holes, 157 for fuel injectors, and possibly other engine components such as sensors or pressure release valves, are also present in the sleeve 100*s*.

As best seen in FIG. 2, surrounding the portion of the cylinder liner sidewall that is encompassed by the combustion area 20 is a central rib 120. In the central rib 120 are ports 122 for fuel injectors, and possibly other engine components such as sensors or pressure release valves. Emanating outward from the central rib 120 are ribs 137 and 142 that create feed channels 138 and 143. The feed channels 138 and 143 are open at one end, at an outlet opening. The open end is adjacent to an annular groove 139 and 145. In the center section 107 there are two annular grooves: an intake side annular groove 145 and an exhaust side annular groove 139. Correspondingly, there are two groups of ribs and feed channels: intake end ribs 142 and intake end feed channels 143, as well as exhaust end ribs 137 and exhaust end feed channels 138. The exhaust side annular groove 139 has openings 181 to bridge cooling channels 182. The sidewall portions between the openings through the cylinder liner sidewall that make up each port (e.g., intake and exhaust ports) are referred to as bridges in this disclosure. Bridge cooling channels 182 are structures that allow for fluid flow through from the openings 181, through the portion of the cylinder liner that makes up the bridges, to the portion of the cylinder liner that is between the liner end and the exhaust port. The outlet openings 184 of the bridge cooling channels are located at the end, or outer edge, of the cylinder liner 100L.

FIG. 1 shows the sleeve 100*s* fitted onto the cylinder liner 100L and a cut is taken out of the cylinder assembly 100 so that structures formed by the sleeve 100*s* when fitted onto the center section 107 can be seen. An annular exhaust end coolant reservoir 170*e* is formed by the annular groove 145 on the cylinder sidewall and the annular recess 159 on the inner surface of the sleeve. Correspondingly, an annular intake end coolant reservoir 170*i* is formed by the annular groove 145 on the cylinder sidewall and the annular recess 161 on the inner surface of the sleeve.

In use, coolant enters the cylinder assembly through the sleeve 100*s* via the impingement jet ports 153 and 155 and the auxiliary jet ports 195, as needed. The impingement jet ports 153 and 155 and auxiliary jet ports 195 are openings through the sleeve sidewall and are configured to deliver coolant to the coolant feed channels 138 and 143 in areas close to the combustion area (e.g., central rib 120) of the cylinder liner when an assembly is in use. On the intake side of the center section 107, the coolant flows from the impingement jet ports 155 (and optionally also from the auxiliary jet ports 195), into the feed channels 143 to the coolant reservoir 170*i*; eventually coolant exits through the exit port 192 to a cylinder block structure that conveys the coolant to a system (not shown) that dissipates the accumulated heat and recirculates the coolant. On the exhaust side of the center section 107, coolant flows from the impingement jet ports 153 (and optionally also from the auxiliary jet ports 195) to the feed channels 138 to the coolant reservoir 170*e*. From the coolant reservoir 170*e*, some of the coolant can flow out the bypass ports 190 to the coolant system for recirculation and subsequent reintroduction to the cylinder assembly through the impingement jet ports 153 and 155 or through the auxiliary jet ports 195. The bypass ports 190 can be actively controlled with valves (not shown) or can be sized to achieve preferred cooling profiles in the engine. Alternatively, some, or all, of the coolant can be directed from the exhaust side coolant reservoir 170*e* to the openings 181 and into the bridge channels 182. Eventually the coolant exits the cylinder assembly through the outlet openings 184 and the coolant is sent to the rest of the coolant circulation system for heat dissipation and recirculation.

Figure 3:
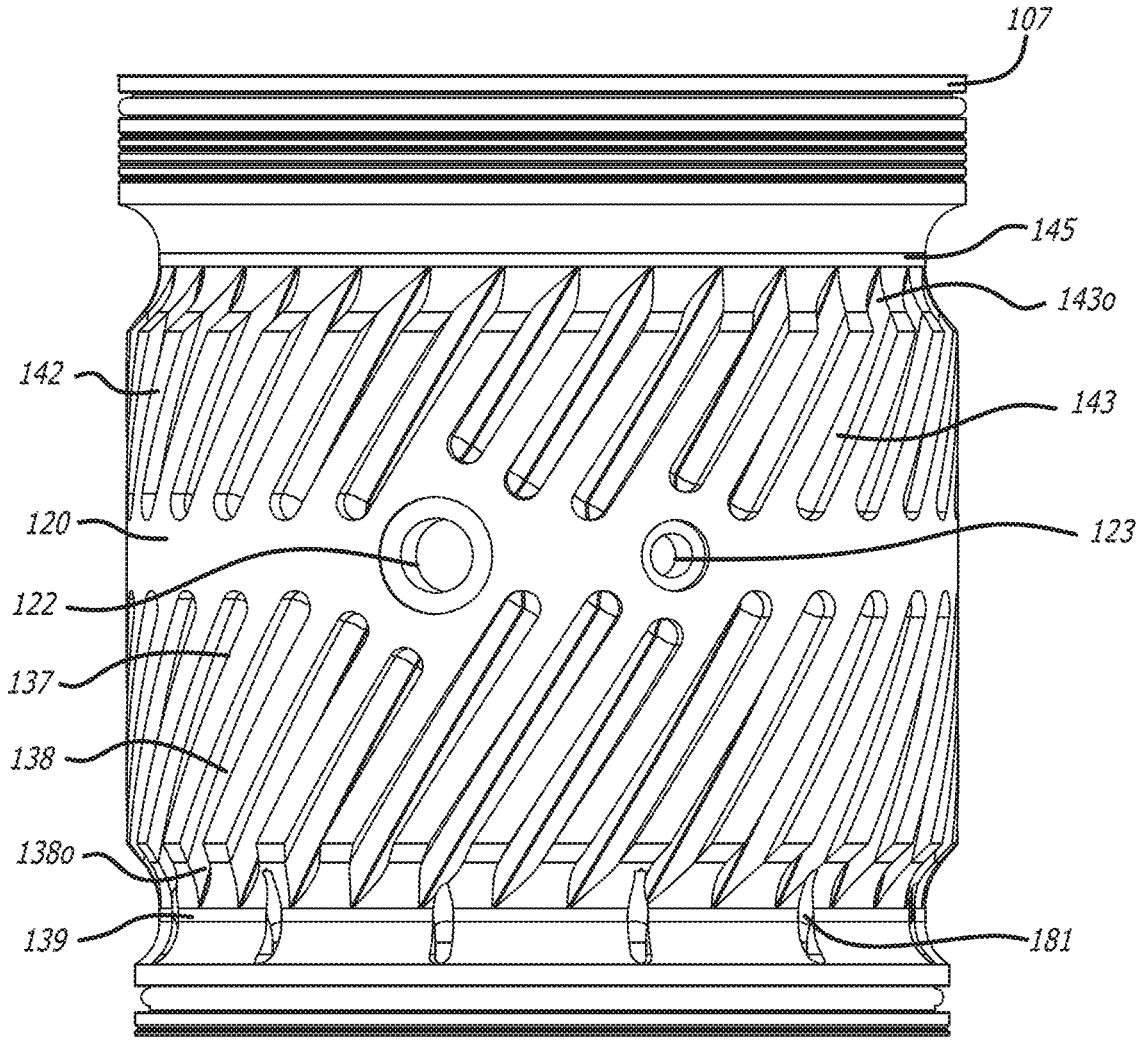
FIG. 3 (Prior Art)
FIG. 3 shows a center portion of a cylinder assembly with cooling features, and is properly labeled "PRIOR ART".

FIG. 3 shows a prior art center section 107 of a cylinder liner 100L similar, to that shown in FIG. 2. The center section 107 is shown with a central rib 120 with a fuel injector port 122 and a miscellaneous port 123 for a sensor, pressure release valve, and the like. The central rib 120 encircles the combustion area (20 in FIG. 1). Ribs 137 and 142 extend from the central rib 120 toward annular grooves 139 and 145. The annular grooves 139 and 145 are spaced-apart on the center section 107 of the cylinder liner 100L. The ribs 137 and 142 form feed channels 138 and 143 that have outlets 138*o* and 143*o* adjacent to the annular grooves 139 and 145. In the annular groove 139 that is configured to be closest to the exhaust port are inlet openings 181 to bridge channels.

Figure 4A:
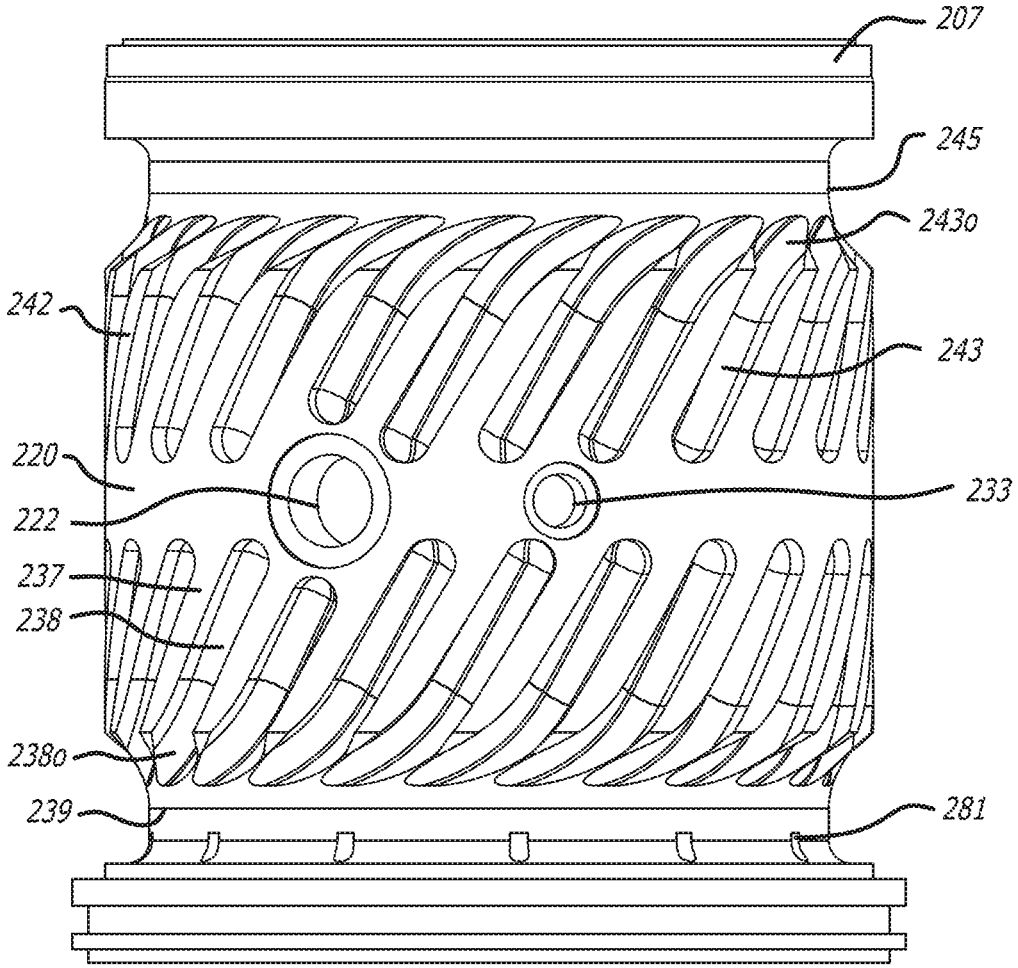
FIG. 4A shows a center portion of a cylinder assembly with cooling features that facilitate coolant flow according to the invention.

According to an aspect of the invention, a center section 207 shown in FIG. 4A may be substituted for the prior art center section 107 in the cylinder assembly 100 seen in FIGS. 1 and 2. As per FIG. 4A, the center section 207 includes a central rib 220 surrounding the combustion area of the cylinder liner, a fuel injector port 222, a miscellaneous port 223, ribs 237 and 242, feed channels 238 and 243, annular grooves 239 and 245, and openings 281 to bridge channels. When covered, the annular grooves 239 and 245 form respective annular coolant reservoirs in which coolant is collected. The feed channels 238 and 243 have groove outlets 238*o* and 243*o* that are shaped to be tangential to the annular grooves and thus to the annular coolant reservoirs formed by the grooves. In use, when coolant flows through feed channels 238 and 243 the shape of the tangential outlets 238*o* and 243*o* encourages flow of the coolant about the annular grooves 239 and 245.

In FIG. 3, the feed channel outlets 138*o* and 143*o* meet the annular grooves 139 and 145 following the path of the feed channels 139 and 143. Coolant flowing through the feed channels 139 and 143 in the center section 107 may stagnate in the annular grooves 139 and 145. Conversely, in the center section 207 in FIG. 4A, the feed channel outlets 238*o* and 243*o* guide coolant flow to minimize areas of stagnation in the annular grooves 239 and 245.

Figure 4B:
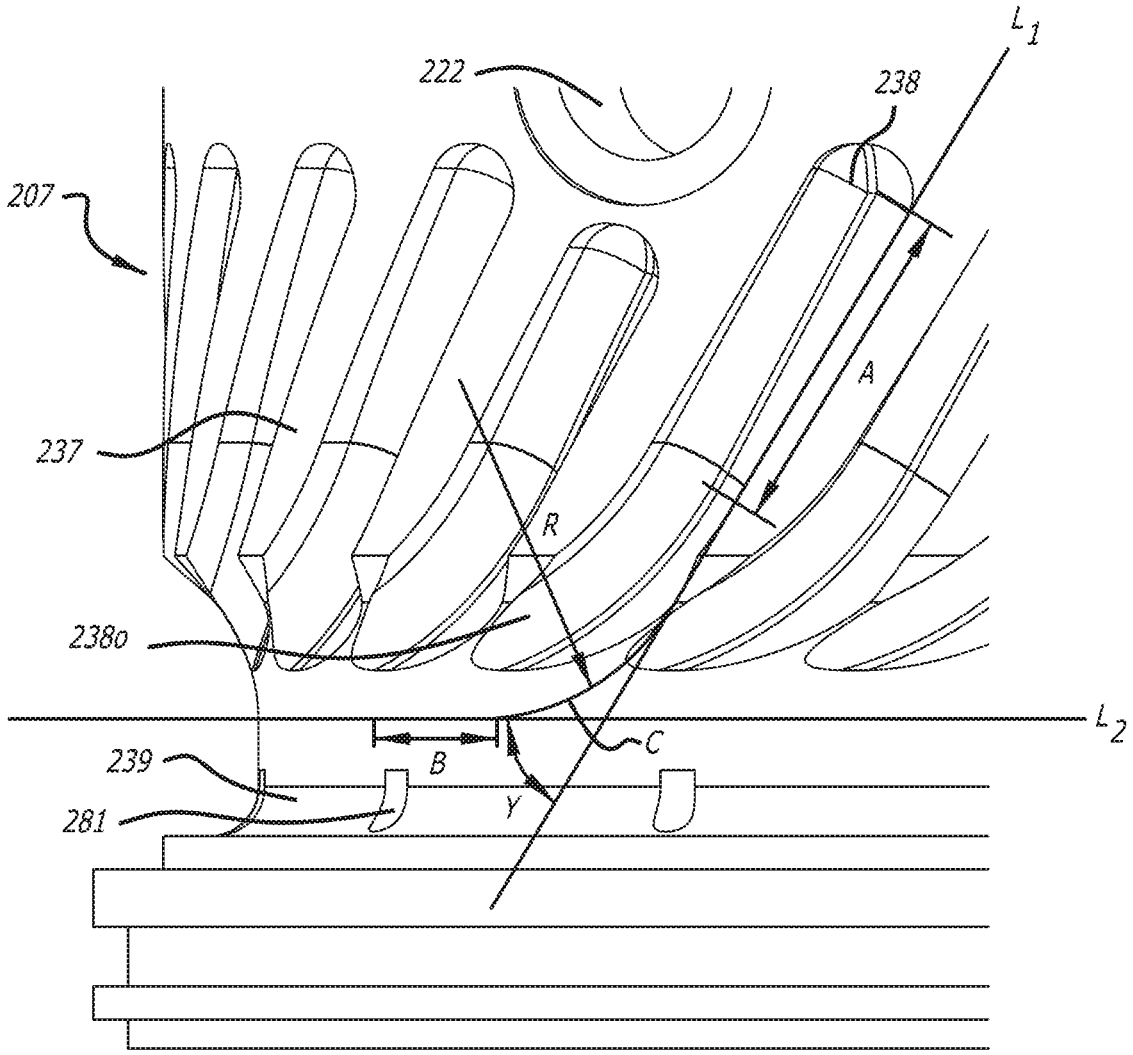
FIG. 4B shows an enlarged view of cooling features.
Figure 4C:
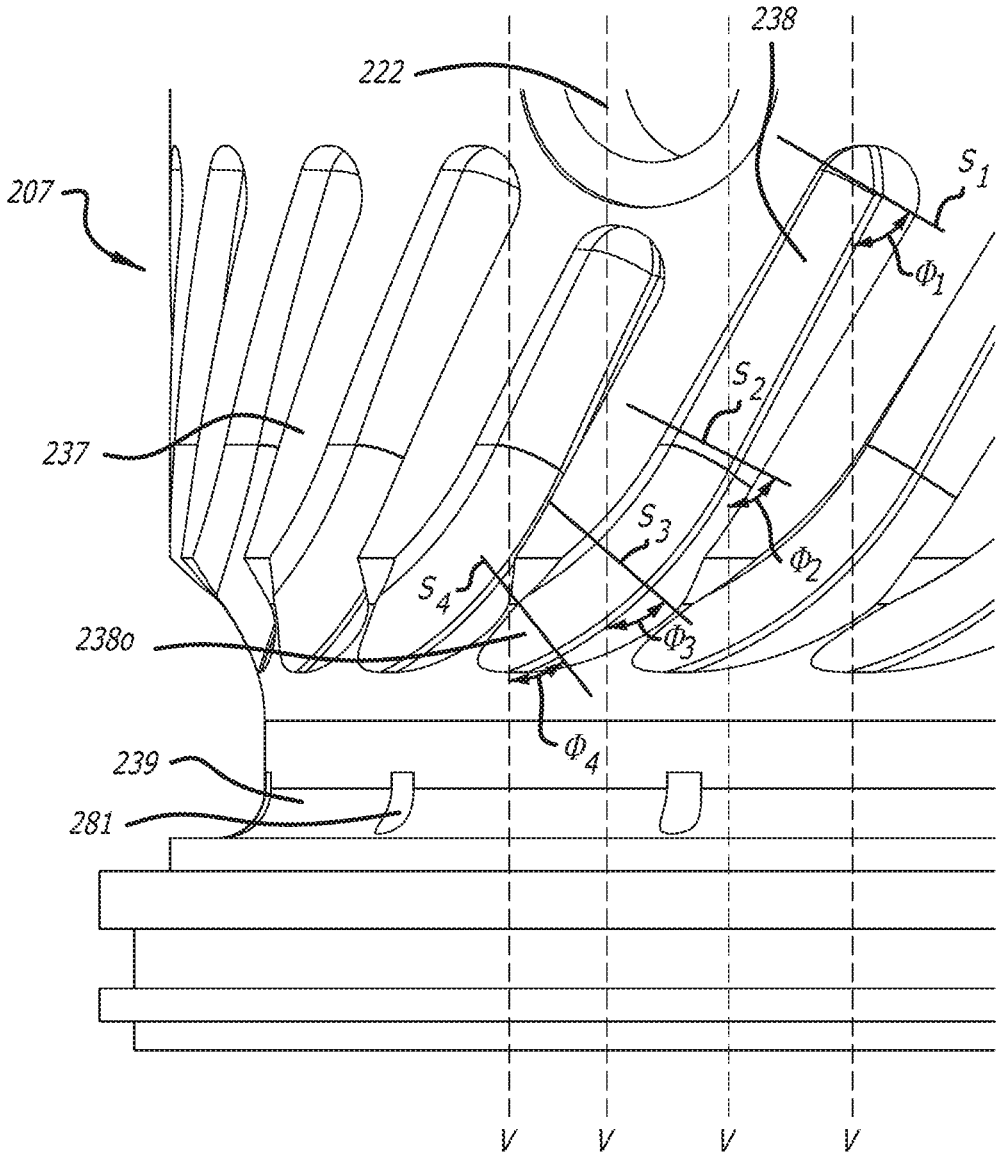
FIG. 4C shows an alternate enlarged view of cooling features.

FIGS. 4B and 4C show enlarged portions of the feed channel outlets and ways to define the feed channels and feed channel outlets. In FIGS. 4B and 4C, a portion of the center section 207 showing the fuel injector port 222, annular groove 239 closest to the exhaust portion of the cylinder, openings 281 to the bridge channels, ribs 237, feed channels 238, and feed channels outlets 238*o* are shown. In FIG. 4B, the feed channel 238 and feed channel outlet 238*o* are delineated into three parts. The part A closest to the middle of the center section 207 is adjacent to a line $L_1$ that follows the contour of part A and has the same slope. The part B adjacent to the annular groove 239 is also adjacent to a line $L_2$ that follows its contour and has the same slope, a slope of substantially 0. There is an angle $\gamma$ between lines $L_1$ and $L_2$. An arc C follows the portion of the feed channel outlet 238*o* that connects the upper part A and the tangential part B. The arc C is defined by a radius of curvature R. The angle $\gamma$ can have a value of between 20° and 75°, or between 30° and 70°, such as between 55° and 65°. By defining the angle $\gamma$ and the radius of curvature R, the shape of the feed channel outlet 238*o* and in turn the amount of mixing can be adjusted to minimize coolant stagnation.

FIG. 4C shows a feed channel 238 and feed channel outlet 238*o* that is segmented into four portions defined by line segments $S_1$, $S_2$, $S_3$, $S_4$ perpendicular to the side of the feed channel with different curve pitches and corresponding pitch angles $\phi_1$, $\phi_2$, $\phi_3$, $\phi_4$. The pitch angles $\phi_1$, $\phi_2$, $\phi_3$, and $\phi_4$ are measured from the respective line segments and a vertical V. The first line segment $S_1$ is closest to the middle of the center section 207. The first line segment $S_1$ and the second line segment $S_2$ can have the same curve pitch so that $\phi_1=\phi_2$. Alternatively, first line segment $S_1$ and the second line segment $S_2$ can have differing angles $\phi_1$, $\phi_2$. In FIG. 4C, the third line segment $S_3$ has a different pitch angle $\phi_3$ and the fourth line segment $S_4$ another distinct pitch angle $\phi_4$ The shape of the feed channel 238 and the feed channel outlet 238*o* can be defined by a series of line segments with associated pitches. Though four line segments are shown in FIG. 4C, more line segments can be provided with associated pitch values to define a feed channel 238 and outlet 238*o* shape. A smooth curve is extrapolated between the line segments. The curve pitch changes along the length of the feed channel 238 dictate the shape of these features and can determine the amount of coolant mixing.

Though the feed channels 238 and 243 shown in FIG. 4A are of similar dimensions, the feed channels 243 on the intake side may be different from those feed channels 238 on the exhaust side. The intake side feed channels 243 may not require as much coolant to flow through as those on the exhaust side, and so maybe narrower or shallower. Additionally, or alternatively, the outlets 243*o* of the feed channels on the intake side may be curved or shaped differently from those outlets 238*o* on the exhaust side so that the resulting flow rates reflect the different cooling needs of the exhaust side versus the intake side.

The cooling feed channels can be configured so that coolant flows from the combustion area, or adjacent the center rib, towards the annular grooves, in opposite directions when the cylinder assembly is in use. The cooling feed channels 243 on the intake side, those situated between the combustion area (e.g., the central rib 220) and the annular groove 245 adjacent to the intake port, can cause coolant to flow in a counterclockwise direction in the annular groove 245. On the other end of the center section 207 of the cylinder liner, the cooling feed channels 238 on the exhaust side, those feed channels situated between the combustion area and the annular groove 239 adjacent to the exhaust port, can cause coolant flow in a clockwise direction in that annular groove (the one adjacent to the exhaust port). Additionally, the converse can be true, and coolant can flow clockwise in the annular groove 245 adjacent to the intake port and counterclockwise in the annular groove 239 adjacent to the exhaust port.

Figure 5:
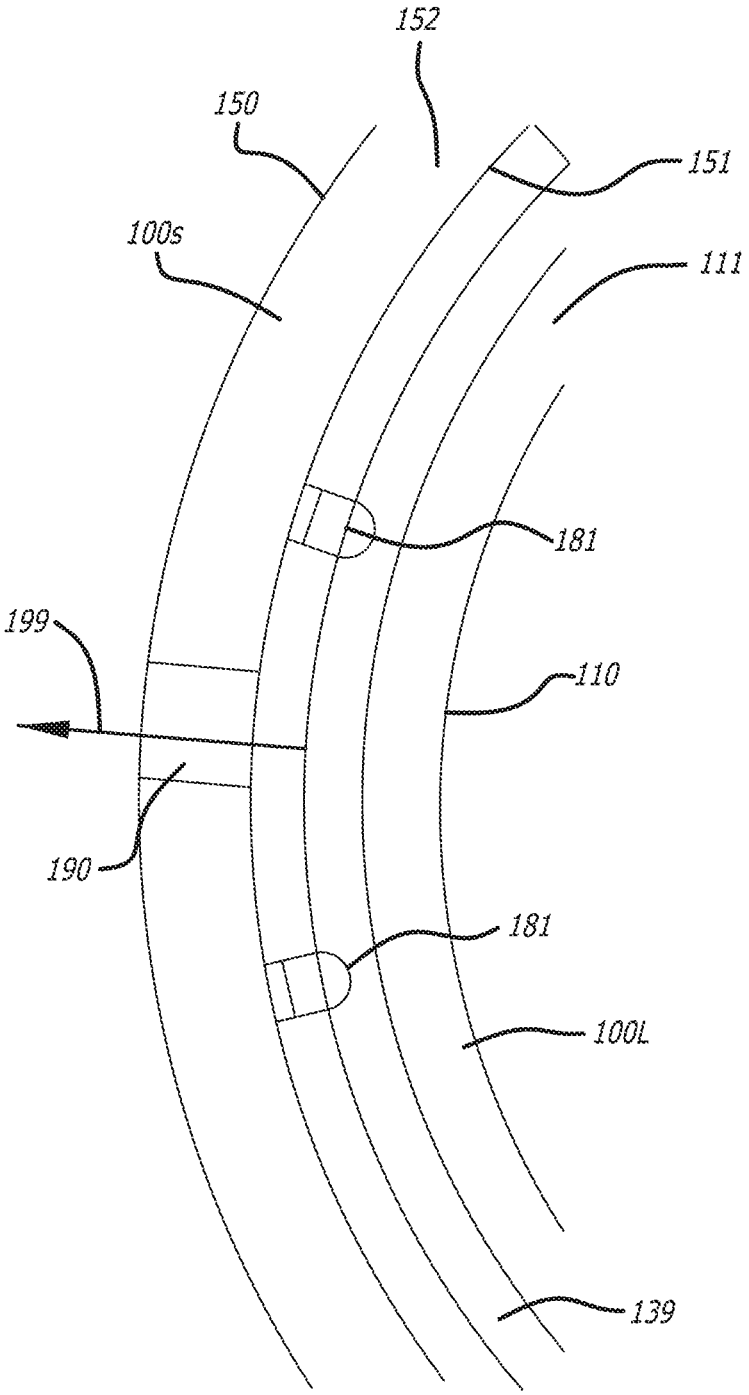
FIG. 5 (Prior Art)
FIG. 5 shows a partial cross-section of a prior art cylinder assembly, viewed from a cut taken through a location through openings into bridge channels, viewing towards the exhaust end of the cylinder assembly.

FIG. 5 shows a partial cross-section of a prior art cylinder assembly, viewed from a cut taken through a location through openings into bridge channels, viewing towards the exhaust end of the cylinder assembly. In FIG. 5, the sleeve 100*s* can be seen fitted onto the cylinder liner 100L. The cylinder liner 100L is shown with a sidewall 111 forming a bore surface 110. An annular groove 139 is formed in the sidewall 111, and in the annular groove 139 are openings 181 into bridge cooling channels (182 in FIG. 2). The sleeve 100*s* has an outer surface 150 and an inner surface 151. The inner surface 151 forms a coolant reservoir with the annular groove 139 in the cylinder liner 100L. In use, the coolant reservoir is in fluid communication with the openings 181 to the bridge cooling channels, as well as bypass ports 190. A bypass port 190 is shown in FIG. 5 providing a path for fluid coolant to flow from the coolant reservoir formed by the annular groove 139, through the sleeve sidewall 152, to the rest of the cylinder block, extremal to the cylinder assembly. The direction 199 of coolant flow is shown as substantially perpendicular to a tangent to the outer surface 150; flow of the coolant is straight out from the bypass port 190.

Figure 6:
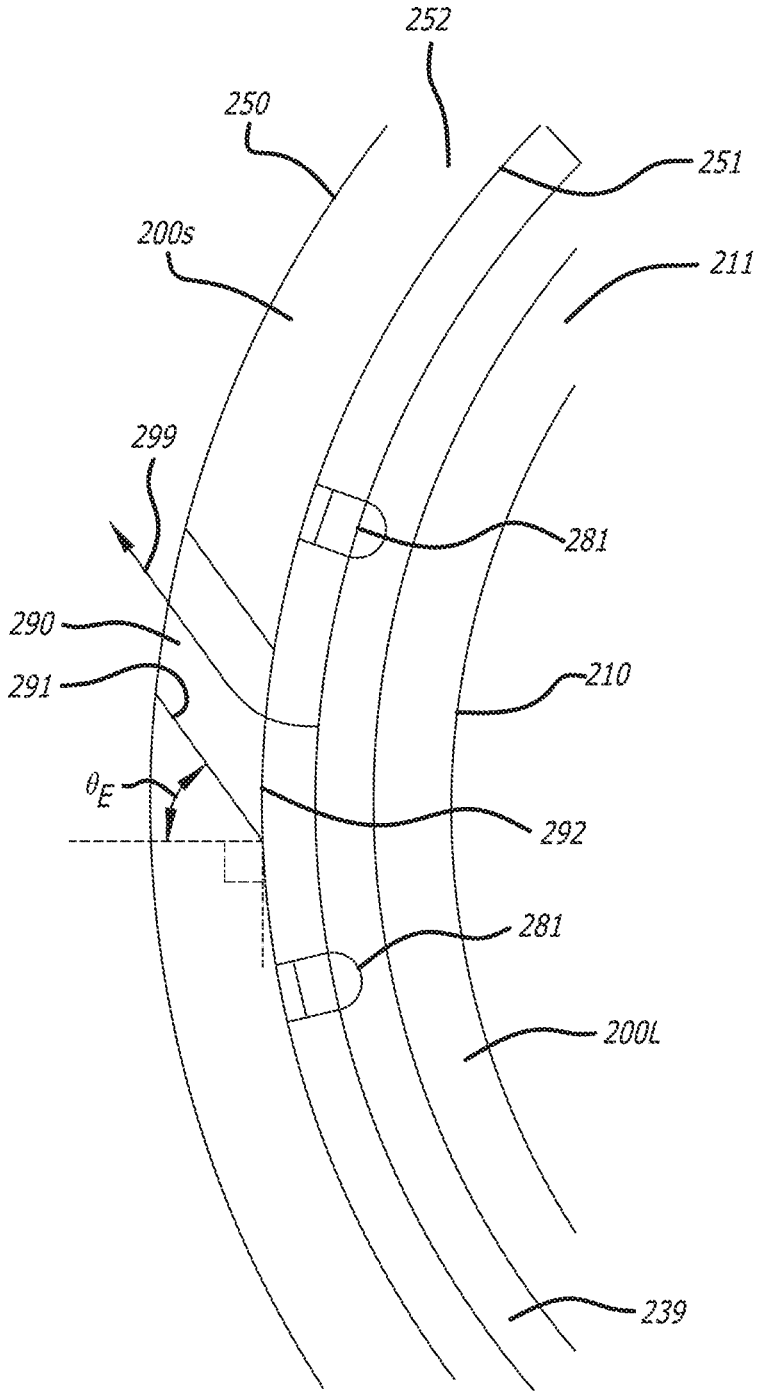
FIG. 6 shows a partial cross-section of a cylinder assembly, viewed from a cut taken through a location through openings into bridge channels, viewing towards the exhaust end of the cylinder assembly.

FIG. 6 shows a partial cross-section of a cylinder assembly, viewed from a cut taken through a location through openings into bridge channels, viewing towards the exhaust end of the cylinder assembly. As in FIG. 5, the section in FIG. 6 shows a sleeve 200*s* fitted onto a cylinder liner 200L. The cylinder liner 200L has a sidewall 211 which forms a bore surface 210 on one side and is adjacent the sleeve 200*s* inner surface 251 on the other side. The cylinder liner sidewall 211 also has an annular groove 239. In the annular groove 239 are openings 281 to bridge cooling channels that pass through bridges in between openings in the cylinder liner's exhaust port. The sleeve 200*s* has a sidewall 252 with an outer surface 250, the inner surface 251 that is adjacent the cylinder liner 200L, and a bypass port 290 that provides a fluid flow path for coolant from a coolant reservoir through the sleeve sidewall 252. The coolant reservoir is formed by the annular groove 239 and sidewall inner surface 251.

It can be seen that the bypass port 290 does not provide the shortest route from the inside surface 251 to the outside surface 250 of the sleeve. Instead, the bypass port 290 is formed so that its sidewalls 291 are at an angle $\Theta_E$ from a line perpendicular to a tangent line taken on the inner surface 251 of the sleeve at an opening 292 of the bypass port 290. The direction 299 of coolant flow from the coolant reservoir through the bypass port 290 is shown in FIG. 6 as being at an angle that is not perpendicular to a tangent to the outer surface 250 of the sleeve 252 at the bypass port 290; the direction of fluid flow follows somewhat the angle $\Theta_E$ of the sidewall 291 of the bypass port 290. This coolant flow direction is tangential, and not perpendicular, to the sleeve 252 upon exit from the bypass port 290 allows for coolant flow that moves along the outer side 250 of the sleeve, thereby reducing flow stagnation. The angle $\Theta_E$ can range from 10° to 80°, including from 20° to 60°, or from 30° to 50°. The angle $\Theta_E$, can be 50'.

The coolant that leaves the cylinder assembly through the bypass port 290 is provided to the coolant system (not shown) where the heat the coolant has absorbed dissipates and the coolant is returned to the cylinder assembly through the impingement jet ports (153 and 155 in FIG. 1 and FIG. 2) and/or auxiliary jet ports in the sleeve of the assembly. Preventing coolant stagnation in the area outside of the cylinder assembly as the coolant leaves the bypass port 290 prevents coolant stagnation in the engine block. Further, the flow of cooling fluid from the center section of the cylinder through the bypass port 290 diverts fluid that has absorbed heat from the center section 207 while flowing through the cooling feed channels 238. At the same time some of the coolant is diverted to the port bridge cooling channels (182 in FIG. 2) and then to the end of the cylinder assembly to remove heat from the exhaust end of the cylinder.

Figure 7:
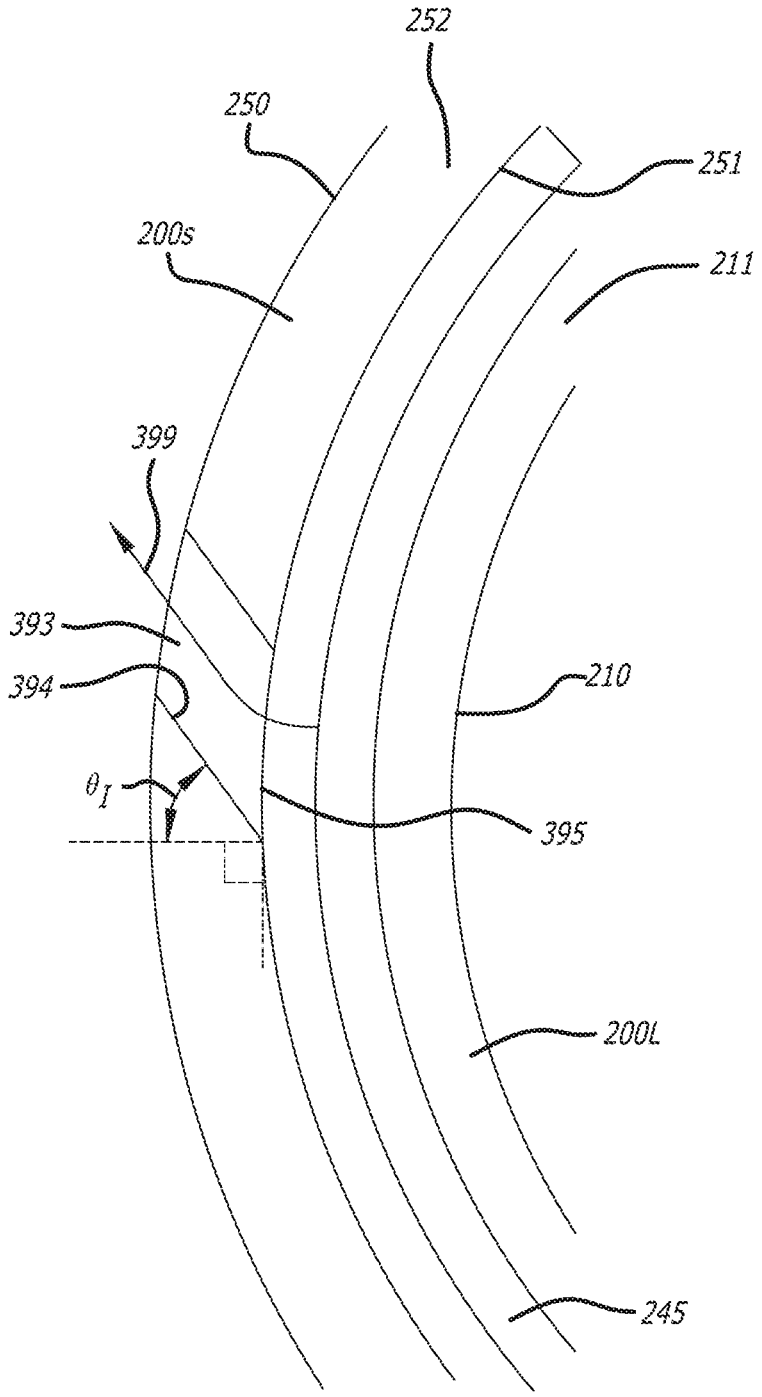
FIG. 7 shows a partial cross-section of a cylinder assembly, viewed from a cut taken through intake side coolant exit ports, viewing towards the exhaust end of the cylinder assembly.

FIG. 7 shows a partial cross-section of a cylinder assembly, viewed from a cut taken through a location through coolant exit ports 393 (192 in FIGS. 1 and 2) on the intake end of the cylinder assembly. Similar to the section shown in FIG. 6, the section shows a sleeve 200*s* fitted into a cylinder liner 200L. The sleeve 200*s* has a sidewall 252 with an outer surface 250, the inner surface 251 that is adjacent the cylinder liner 200L, and a coolant exit port 393 that provides a fluid flow path for coolant from a coolant reservoir through the sleeve sidewall 252. The coolant reservoir is formed by the annular groove 245 and sidewall inner surface 251. As coolant flows through the engine, coolant collects in the coolant reservoir formed by the annular groove 245, and then flows out the exit port 393.

Analogous to the bypass port 290 in FIG. 6, the coolant exit port 393 is formed so that its sidewalls 394 are at an angle $\Theta_i$ from a line perpendicular to a tangent line take on the inner surface 251 of the sleeve and an opening 395 of the coolant exit port 393. The direction 399 of coolant flow from the coolant reservoir through the coolant exit port 393 is shown in FIG. 7 as being at an angle that is not perpendicular to a tangent to the outer surface 250 of the sleeve 252 at the coolant exit port 393; the direction of fluid flow follows somewhat the angle $\Theta_i$ of the sidewall 394 of the coolant exit port 393, preventing stagnation in flow as the coolant exits into the cylinder or engine block that surrounds the cylinder assembly. The angle 9, can range from 20° to 60°, including from 25° to 55°, or from 28° to 50°. The angle $\Theta_i$ can be 30°.

Referring now to FIGS. 2, 4, 6, and 7 the invention may be embodied in a cylinder for an opposed-piston engine comprising at least one cylinder comprising a sidewall 211, a bore with a bore surface 210; an exhaust port 113 that is longitudinally spaced from an intake port 114, both ports opening through the sidewall, into the bore, a first plurality of cooling feed channels 238 that extend along the sidewall from a combustion area of the cylinder toward the exhaust port 113, a first annular coolant reservoir 239 in the sidewall in liquid communication with the first plurality of cooling feed channels, a second plurality of cooling feed channels 243 that extend along the sidewall from the combustion area of the cylinder toward the intake port 114, and a second annular coolant reservoir 245 in the sidewall in liquid communication with the second plurality of cooling feed channels. Each of the first cooling feed channels comprises a tangential outlet into the coolant reservoir 239, and each of the second cooling feed channels comprises a tangential outlet into the coolant reservoir 245.

In the foregoing specification, embodiments have been described with reference to numerous specific details that can vary from implementation to implementation. Certain adaptations and modifications of the described embodiments can be made. Other embodiments can be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A cylinder assembly for an opposed-piston engine, comprising:

a cylinder liner with a sidewall, comprising:

longitudinally-spaced exhaust and intake ports opening through the cylinder liner sidewall;

a bore; and a sleeve sidewall with:

a first plurality of cooling feed channels that extend along the cylinder sidewall from a combustion area of the cylinder liner toward the exhaust port; and a second plurality of cooling feed channels that extend along the cylinder sidewall from the combustion area of the cylinder liner toward the intake port; and a sleeve covering a center section of the cylinder sidewall, the sleeve comprising:

a sleeve sidewall with a plurality of impingement jet ports that are arranged in at least one sequence extending around the combustion area and that are in liquid communication with the plurality of cooling feed channels; and an inside surface with spaced-apart first and second annular recesses defining liquid coolant reservoirs on the cylinder sidewall, the first annular recess in liquid communication with the first plurality of feed cooling channels and the second annular recess in liquid communication with the second plurality of feed cooling channels, each cooling feed channel comprising a tangential outlet that curves into one of the coolant reservoirs in a direction that is tangential to the coolant reservoir.

2. The cylinder assembly of claim 1, further comprising a central rib in the combustion area of the cylinder liner.

3. The cylinder assembly of claim 1, further comprising:

a first annular groove in the cylinder liner sidewall located between the exhaust port and the first plurality of cooling feed channels, the first annular groove located adjacent to the first plurality of cooling feed channels; and a second annular groove in the cylinder liner sidewall located between the intake port and the second plurality of cooling feed channels, the second annular groove located adjacent to the second plurality of cooling feed channels.

4. The cylinder assembly of claim 3, further comprising one or more bypass ports that provides a fluid flow path from a coolant reservoir formed by the first annular recess in the cylinder liner and the first annular recesses of the sleeve, through the sleeve sidewall on an exhaust side of the cylinder liner, each bypass port having sidewalls that are at an angle $\Theta_E$ from a line perpendicular to a tangent line taken on an inner surface of the sleeve at the bypass port.

5. The cylinder assembly of claim 3, wherein each cooling feed channel, including its tangential outlet, is configured so that in use:

coolant flow through cooling feed channels between the combustion area and the first annular groove in the cylinder liner sidewall is in a first direction; and coolant flow through cooling feed channels between the combustion area and the second annular groove in the cylinder liner sidewall is in a second direction.

6. The cylinder assembly of claim 5, wherein the first direction is different from the second direction.

7. The cylinder assembly of claim 6, wherein the first direction is substantially opposite that of the second direction.

8. The cylinder assembly of claim 6, wherein the first direction is from the combustion area toward the intake port and the second direction is from the combustion area toward the exhaust port.

9. The cylinder assembly of claim 6, wherein:

the tangential outlet of each coolant feed channel located between the combustion area and the first annular groove is configured to cause coolant flow in a clockwise direction in a first coolant reservoir defined by the first annular groove and the first annular recesses of the sleeve; and the tangential outlet of each coolant feed channel located between the combustion area and the second annular groove is configured to cause coolant flow in a counterclockwise direction in a second coolant reservoir defined by the second annular groove and the second annular recesses of the sleeve.

10. The cylinder assembly of claim 6, wherein:

the tangential outlet of each coolant feed channel located between the combustion area and the first annular groove is configured to cause coolant flow in a counterclockwise direction in a first coolant reservoir defined by the first annular groove and the first annular recesses of the sleeve; and the tangential outlet of each coolant feed channel located between the combustion area and the second annular groove is configured to cause coolant flow in a clockwise direction in a second coolant reservoir defined by the second annular groove and the second annular recesses of the sleeve.

11. A cylinder for an opposed-piston engine, comprising:

a sidewall;

a bore;

longitudinally-spaced exhaust and intake ports opening through the sidewall, into the bore; and a first plurality of cooling feed channels that extend along the sidewall from a combustion area of the cylinder toward the exhaust port;

a first annular coolant reservoir on the sidewall in liquid communication with the first plurality of cooling feed channels;

a second plurality of cooling feed channels that extend along the sidewall from a combustion area of the cylinder toward the intake port; and, a second annular coolant reservoir on the sidewall in liquid communication with the second plurality of cooling feed channels; wherein, each of the first cooling feed channels comprises a tangential outlet that curves into the first coolant reservoir in a direction that is tangential to the first coolant reservoir; and, each of the second cooling feed channels comprises a tangential outlet that curves into the second coolant reservoir in a direction that is tangential to the second coolant reservoir.

12. The cylinder of claim 11, further comprising a central rib in the combustion area of the cylinder liner.

13. The cylinder of claim 11, further comprising:

a first annular groove in the cylinder liner sidewall located between the intake port and the plurality of cooling feed channels, the first annular groove located adjacent to the plurality of cooling feed channels; and a second annular groove in the cylinder liner sidewall located between the exhaust port and the plurality of cooling feed channels, the second annular groove located adjacent to the plurality of cooling feed channels.

14. The cylinder of claim 13, further comprising one or more bypass ports that provides a fluid flow path from a coolant reservoir formed by the second annular recess in the cylinder liner and one of the spaced-apart annular recesses of the sleeve, through the sleeve sidewall on an exhaust side of the cylinder liner, each bypass port having sidewalls that are at an angle $\Theta_E$ from a line perpendicular to a tangent line taken on an inner surface of the sleeve at the bypass port.

15. The cylinder of claim 13, wherein each cooling feed channel, including its tangential outlet, is configured so that in use:

coolant flow through cooling feed channels between the combustion area and the first annular groove in the cylinder liner sidewall is in a first direction; and coolant flow through cooling feed channels between the combustion area and the second annular groove in the cylinder sidewall is in a second direction.

16. The cylinder of claim 15, wherein the first direction is different from the second direction.

17. The cylinder of claim 16, wherein the first direction is substantially opposite that of the second direction.

18. The cylinder of claim 16, wherein the first direction is from the combustion area toward the intake port and the second direction is from the combustion area toward the exhaust port.

19. The cylinder of claim 16, wherein:

the tangential outlet of each coolant feed channel located between the combustion area and the first annular groove is configured to cause coolant flow in a clockwise direction in a first coolant reservoir defined by the first annular groove and a first of the spaced-apart annular recesses of the sleeve; and the tangential outlet of each coolant feed channel located between the combustion area and the second annular groove is configured to cause coolant flow in a counterclockwise direction in a second coolant reservoir defined by the second annular groove and a second of the spaced-apart annular recesses of the sleeve.

20. The cylinder assembly of claim 16, wherein;

the tangential outlet of each coolant feed channel located between the combustion area and the first annular groove is configured to cause coolant flow in a counterclockwise direction in a first coolant reservoir defined by the first annular groove and a first of the spaced-apart annular recesses of the sleeve; and the tangential outlet of each coolant feed channel located between the combustion area and the second annular groove is configured to cause coolant flow in a clockwise direction in a second coolant reservoir defined by the second annular groove and a second of the spaced-apart annular recesses of the sleeve.

* * * * *